US008887969B2

(12) United States Patent
Steiner et al.

(10) Patent No.: US 8,887,969 B2
(45) Date of Patent: Nov. 18, 2014

(54) POURING NOZZLE

(75) Inventors: Benno Steiner, Nebikon (CH); Christoph Eglsäer, Bruck a.d. Mur (AT); Wilhelm Janko, Graz (AT)

(73) Assignee: Refractory Intellectual Property GmbH & Co. KG, Vienna (AT)

( * ) Notice: Subject to any disclaimer, the term of this patent is extended or adjusted under 35 U.S.C. 154(b) by 322 days.

(21) Appl. No.: 13/266,518

(22) PCT Filed: Jun. 11, 2010

(86) PCT No.: PCT/EP2010/003520

§ 371 (c)(1), (2), (4) Date: Oct. 27, 2011

(87) PCT Pub. No.: WO2011/000468

PCT Pub. Date: Jan. 6, 2011

(65) Prior Publication Data

US 2012/0043354 A1 Feb. 23, 2012

(30) Foreign Application Priority Data

Jul. 1, 2009 (EP) ..... 09008614

(51) Int. Cl.
*B22D 41/00* (2006.01)
*B22D 41/56* (2006.01)

(52) U.S. Cl.
CPC ..... *B22D 41/56* (2013.01)
USPC ..... 222/591; 222/606

(58) Field of Classification Search
CPC ..... B22D 41/50; B22D 41/34; B22D 41/56; B22D 41/24; B22D 41/28; B22D 11/00; B22D 41/40; B22D 25/02; B22D 37/00; B22D 41/00; B22D 41/22; B22D 41/38; B22D 41/08; B29C 2945/76277; B29C 2945/76598; G01N 1/125; B21B 1/22; C21B 7/14; C22B 21/009; C22B 21/0092
USPC ..... 222/600, 606, 591, 607; 164/435, 437, 164/335
See application file for complete search history.

(56) References Cited

U.S. PATENT DOCUMENTS 4,526,304 A * 7/1985 Nishimura ..... 222/607
5,198,126 A * 3/1993 Lee ..... 222/606

(Continued)

FOREIGN PATENT DOCUMENTS

EP 1289696 A1 3/2003
EP 1590114 B1 3/2006

OTHER PUBLICATIONS

State Intellectual Property Office of the People's Republic of China, "Notification to Grant Patent Right for Invention" for corresponding Chinese Patent Application No. 201080022341.9 dated Mar. 25, 2014, with attached English translation of allowed claims.

*Primary Examiner* — Scott Kastler
*Assistant Examiner* — Michael Aboagye
(74) *Attorney, Agent, or Firm* — Christopher L. Parmelee; Walker & Jocke

(57) ABSTRACT

The pouring nozzle comprises an elongated, tubular part, defining a lower part of a pouring channel with a central longitudinal axis L, a plate-like part, provided with a flow-through opening between its surface opposite the tubular part and its section adjacent said tubular part. The flow-through opening defines an upper part of the pouring channel. The peripheral area between said surface and said section comprises four segments, namely two inclined bearing surfaces, opposite to each other, and two planar surface sections, arranged opposite and parallel to each other between said two distinct bearing surfaces. Each bearing surface is curved with respect to the central longitudinal axis L of the pouring channel. The curvature is therefore concave with respect to the central longitudinal axis L and in view of the opposite arrangement of the bearing surfaces the said bearing surfaces are arranged inversely to each other.

14 Claims, 6 Drawing Sheets

(56) References Cited

U.S. PATENT DOCUMENTS 5,390,902 A * 2/1995 Szadkowski ..... 266/217
5,954,989 A * 9/1999 Brook et al. ..... 222/600
6,772,922 B2 * 8/2004 Renard et al. ..... 222/600
8,127,972 B2 * 3/2012 Hanse et al. ..... 222/606

* cited by examiner

L
16
12
14
26
22
18
24
26
20
30l
30m
30r
10
L

C-C
R3
12
26
28
Pm
Pl
Pr
24
30l
30m
30r
10

POURING NOZZLE

This invention relates to a pouring nozzle which nozzle serves for the transfer of a metal melt from one (upper) metallurgical vessel like a ladle to another (lower) metallurgical vessel such as a tundish.

In view of the harsh conditions during metal casting (temperatures up to 1.700° C., chemical and metallurgical attack) such pouring nozzle is usually made of a high temperature resistance ceramic refractory material.

The pouring nozzle typically comprises an elongated, tubular part, defining one part of a pouring channel with a central longitudinal axis and a plate-like part, provided with a flow-through opening between its surface opposite the tubular part and its section adjacent said tubular part, wherein the flow-through opening defines a second part of said pouring channel.

Insofar the general design of a pouring nozzle is more or less identical, independently of whether it is used as a so called "inner pouring nozzle", installed in the said upper metallurgical vessel (e.g. a ladle) or used as an "outer pouring nozzle" following the said inner pouring nozzle in the flow direction of the metallurgical melt. This "outer pouring nozzle" may be designed as a "submerged entry nozzle". Frequently it is designed as a "pouring nozzle for a nozzle insertion and/or removal device", especially for a quick change during casting.

When used as an "inner pouring nozzle" the said plate-like part is usually arranged at the lower end (in the flow direction of the melt) while the outer pouring nozzle is arranged vice versa when used in a tube changer.

In both cases means are provided for holding the nozzle precisely in the desired position. Insofar known nozzles are provided with bearing surfaces along the peripheral area of said plate-like part.

According to EP 1 289 696 B1 and EP 1 590 114 B1 the said plate-like part comprises, on opposite sides, two planar bearing surfaces forming an angle of 20° to 80° with the central longitudinal axis of the pouring channel.

In use, the plate-like part of such pouring nozzles is held in place against a corresponding plate-like part of another refractory component. This other refractory component may, for example, be a refractory plate component of a slide gate system, or may be the plate-like part of a corresponding pouring nozzle. The plate-like parts are subjected to different levels of thermal expansion in the region adjacent to the pouring channel and the region most distant from the pouring channel. This can cause the otherwise flat plate-like part to be caused to bend to accommodate the higher level of expansion in the region of the pouring channel. The effect of this is that the area of contact between the plate-like parts of the pouring nozzles and their corresponding other refractory component is decreased, and becomes limited to a relatively small annular section circumscribing the pouring channel. This creates a number of risks. Firstly, the thermo-mechanical stresses induced by the differential expansion across the plate-like region can give rise to the propagation of micro-cracks or cracks within said plate-like part and/or in the region between said plate-like part and the adjacent tubular-like part. Secondly, the reduced area of contact leads to a diminished sealing between the refractory components which can allow air ingress to the molten metal stream (leading to oxidation and deterioration in the quality of the cast steel) or, conversely, leakage of molten steel.

In this respect there is a permanent demand to increase and optimize the design, the safety and/or the use of said type of nozzles.

SUMMARY

Typically a number of pushing devices (pushing cylinders) are acting on each bearing surface. These pushing devices are arranged side by side (in parallel) in a way that their respective forces of pressure are more or less parallel to each other. Each of them exercises a more or less identical force onto the corresponding part of the bearing surface. However, these forces are not necessarily directed to the region of the plate-like part around the pouring channel to which the contact area is restricted and where the thermo-mechanically stresses are greatest. This limitation is overcome by the design of pouring nozzles of the present invention wherein the respective bearing surfaces are curved instead of planar.

Applicant's invention provides a pouring nozzle of the type mentioned with improved stress distribution in the plate and focussing the pushing forces towards the area around the pouring channel.

The invention replaces the planar bearing surface according to prior art by a curved bearing surface, including a bearing surface being curved with respect to the central longitudinal axis of the pouring channel. This makes it possible to exert pressure forces in a more concentric manner (with respect to the central longitudinal axis of the pouring channel) into the refractory material.

In its most general embodiment the invention relates to a pouring nozzle comprising the following features:

- an elongated, tubular part, defining a first part of a pouring channel with a central longitudinal axis,
- a plate-like part provided with a flow-through opening between its surface opposite the tubular part and its section adjacent said tubular part,
- the flow-through opening defining a second part of the pouring channel,
- a peripheral area between said surface and said section comprising two bearing surfaces,
- each bearing surface provides at least one curvature, extending along an imaginary plane perpendicular to the direction of the central longitudinal axis (L),
- said bearing surfaces are arranged inversely.

The inverse arrangement of the bearing surfaces leads to a design of the plate-like part of the pouring nozzle which may be mirror-inverted with respect to an imaginary longitudinal plane including the central longitudinal axis of the pouring channel.

In a preferred embodiment the peripheral area comprises two distinct bearing surfaces and two planar surface sections arranged parallel to each other and between said two distinct bearing surfaces. In other words: The peripheral area of the plate-like part is as follows: One curved bearing surface is followed by a planar surface section, which then is followed by the second curved bearing surface and the latter then again followed by a planar surface section. The plate like part typically is of rectangular/square shape (seen from above). A corresponding design is shown in the attached drawings.

The said curvature of the bearing surfaces may be of a constant radius or can vary along the bearing surface. This enables to provide radial forces from the pushing devices into the plate like section of the nozzle. Depending on the curvature the pressure forces do not extend any more parallel to each other but in a converging manner.

According to another embodiment the said two bearing surfaces each provide a curvature corresponding to a parabola in a cross section perpendicular to the central longitudinal axis of said pouring channel.

The design described above presents a nozzle with two bearing surfaces each of which being characterized by a curvature along an imaginary plane, which imaginary plane is perpendicular or inclined respectively to the direction of the central longitudinal axis of the pouring channel. This design includes embodiments wherein a radius $R_2$ or $R_3$ of said curvature is larger than the diameter D of the flow through opening (bore), e.g. more than 2 times larger or more than 3 times larger, more than 5 times larger or more than 10 times larger.

According to another embodiment each of said two bearing surfaces may in addition provide a curvature, extending along an imaginary plane comprising the longitudinal axis of the pouring channel, which curvature extends in a direction from said surface opposite the tubular part to said section adjacent said tubular part.

Said second type of curvature may be of constant radius between its end opposite the tubular part and said section adjacent said tubular part but typically it will have different radiuses along its extension.

This includes an embodiment wherein said second curvature extends only partially between one end of the plate-like part opposite the tubular part and its second end adjacent said tubular part.

The said bearing surfaces, curved all over its area and/or along a part of it may provide a shape which corresponds at least partially to a partial surface (segment) of one of the following geometrical shapes: cylinder, paraboloid, cone, dome, toroid.

In a longitudinal section the shape of said bearing surfaces may correspond at least partially to at least one of the following geometrical shapes: Parabola, involute, ellipse. Alternatively the bearing surface in the longitudinal section may be linear.

Typically the said plate-like part has a smaller cross sectional area at its section adjacent said tubular part than at its end opposite said tubular part. This leads to an arrangement whereby the pushing forces applied to the bearing surfaces are directed in part upwardly (for the outer pouring nozzle) or downwardly (for the inner pouring nozzle), respectively. In other words: The pushing forces have a vector component in the direction of the corresponding surface of the respective plate like part in order to improve the tightness of said surface to the adjacent component of the system, e.g. a sliding plate of a slide gate valve or the surface of a second nozzle.

In addition the curvature of the bearing surfaces will for all pushing devices concentrate a part of said vector component in the direction of the pouring channel and thereby minimizing the risks arisen from the reduced area of contact created by the differential thermal expansion of the plate like part in use.

The said pouring nozzle may be made of a ceramic refractory material and designed as one piece (so called monotube). It may also be made of separate parts, for example the tubular part and the plate-like part which are then fixed to each other by a common outer metallic envelope and/or a bonding agent (an adhesive).

The nozzle and/or its parts may be pressed isostatically.

Further features of the invention may be derived from the other application documents and/or the sub claims.

BRIEF DESCRIPTION OF THE DRAWINGS

The invention will be described in more detail in accordance with the attached drawings. These drawings schematically show the following.

DETAILED DESCRIPTION

Identical parts or parts providing the same function are designated by same numerals.

Figure 1:
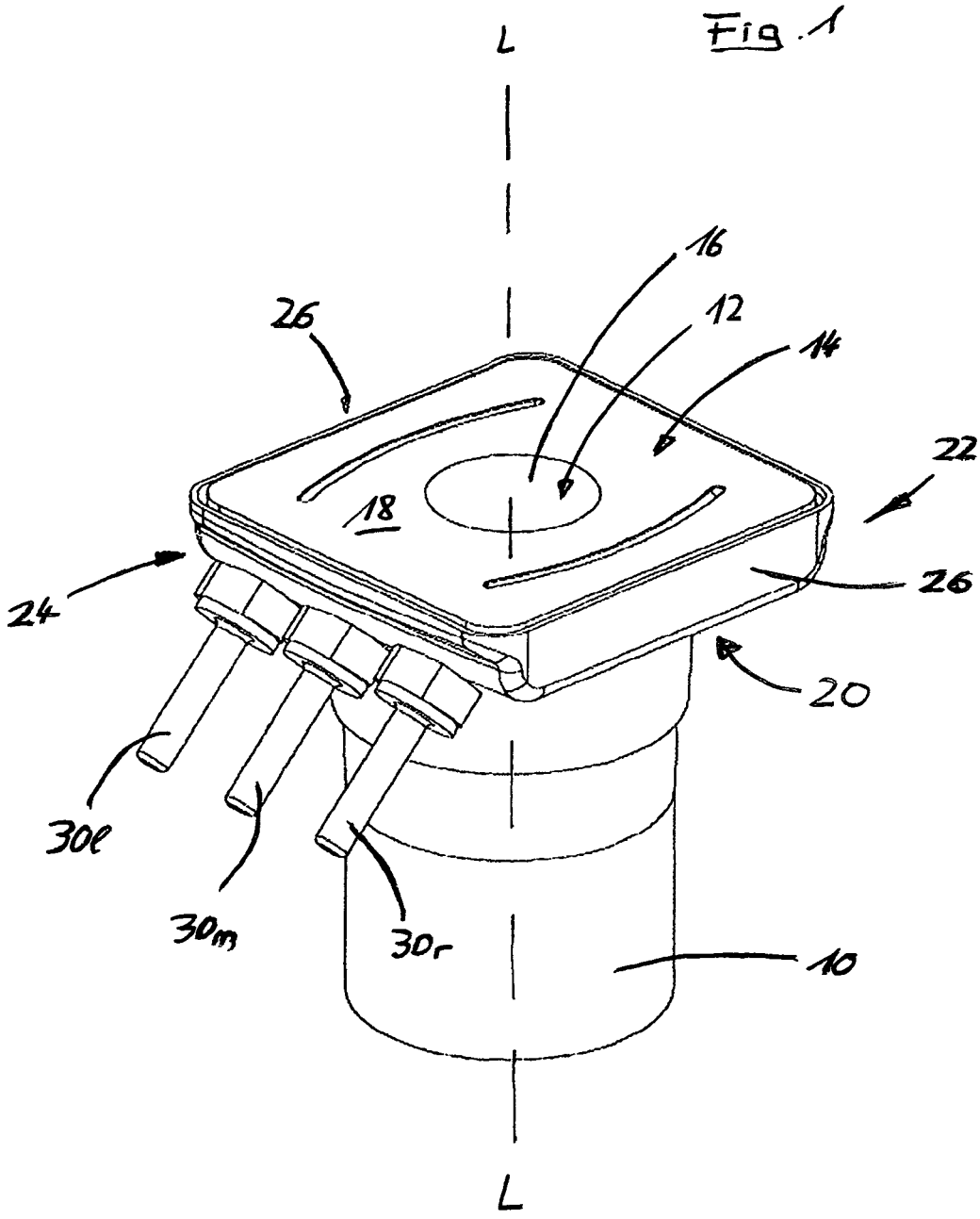
FIG. 1: a 3-dimensional view of a pouring nozzle.

According to FIG. 1 the pouring nozzle comprises an elongated, tubular part 10, defining a lower part of a pouring channel 12 with a central longitudinal axis L, a plate-like part 14, provided with a flow-through opening 16 between its surface 18 opposite the tubular part 10 and its section 20 adjacent said tubular part 10. As may be seen from FIG. 2 the flow-through opening 16 defines an upper part 12*o* of the pouring channel 12.

The peripheral area 22 between said surface 18 and said section 20 comprises four segments, namely two inclined bearing surfaces 24, opposite to each other, and two planar surface sections 26, arranged opposite and parallel to each other between said two distinct bearing surfaces 24.

Figure 3:
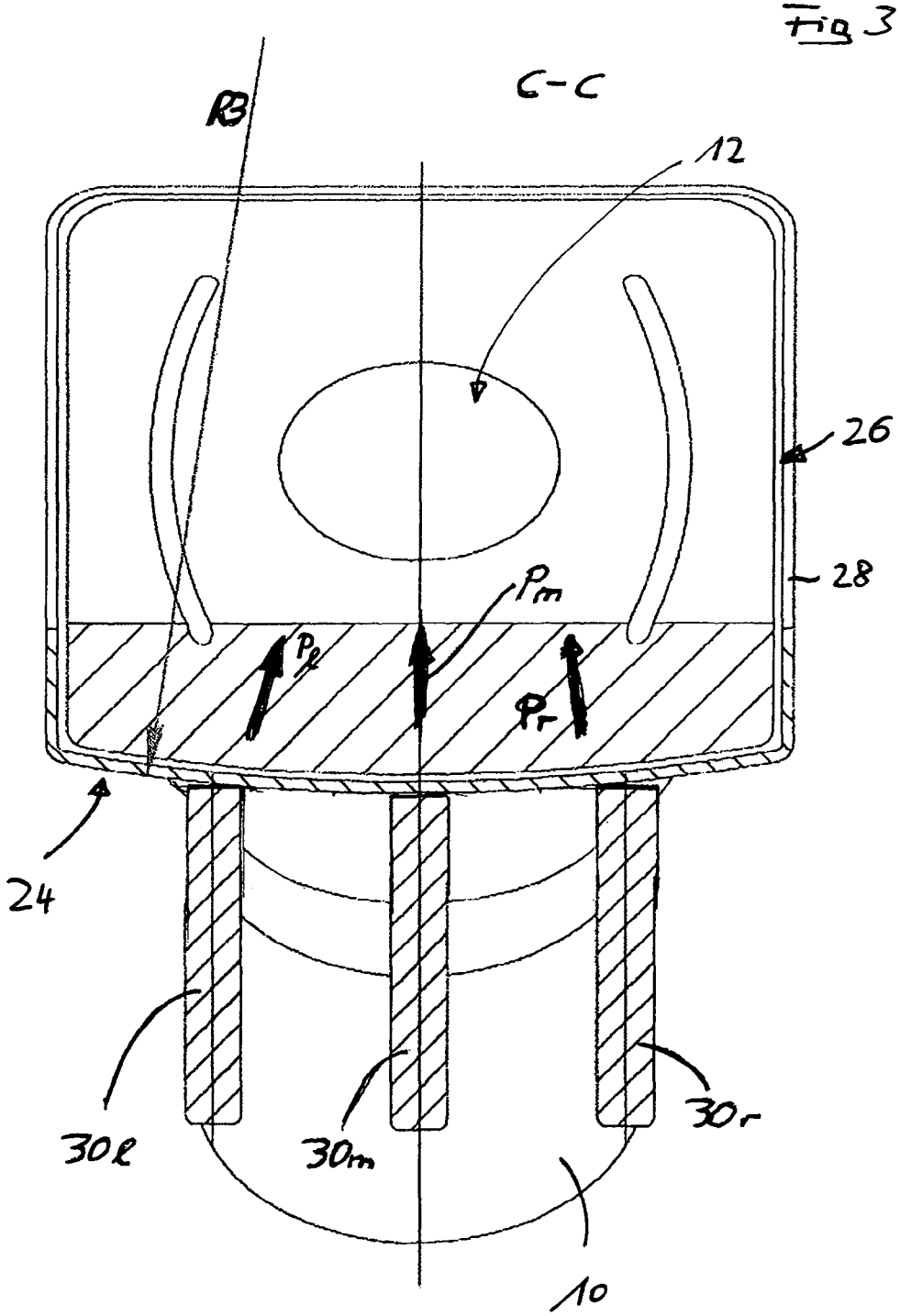
FIG. 3: a cross-sectional view of the nozzle in accordance with FIGS. 1, 2 in the area of pushing devices (C-C of FIG. 2)

Each bearing surface 24 is curved with respect to the central longitudinal axis L of the pouring channel 12, as may be best seen from FIG. 3. The curvature is therefore concave with respect to the central longitudinal axis L and in view of the opposite arrangement of the bearing surfaces 24 the said bearing surfaces are arranged inversely to each other.

Figure 2:
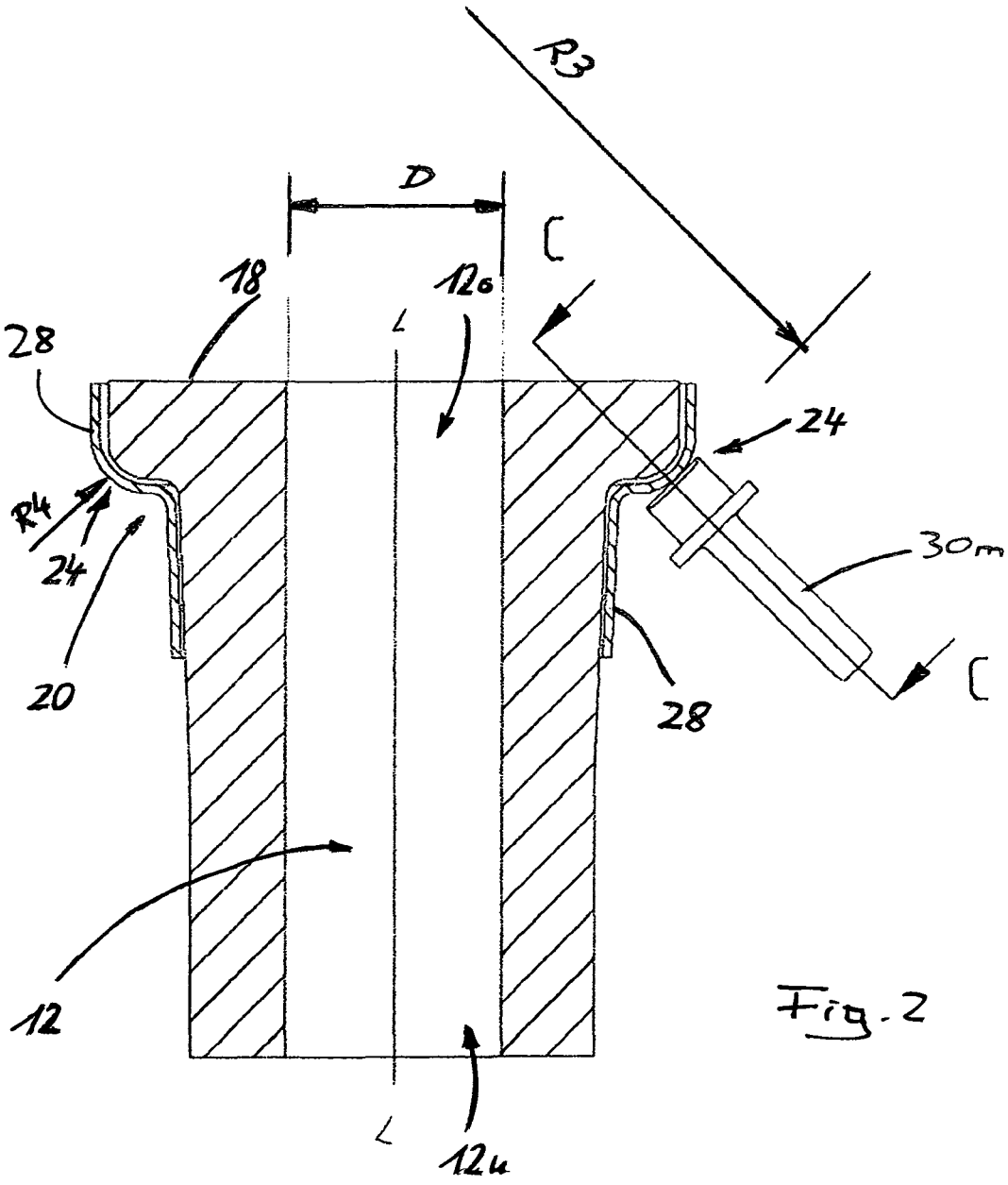
FIG. 2: a longitudinal sectional view of the nozzle in accordance with FIG. 1.

In FIG. 2 the diameter of the flow-through opening 16 is marked as D while the radius of the corresponding curved bearing surface 24 is marked as $R_3$ with $R_3$>D. Radius $R_3$ lies in a plane inclined to the longitudinal axis L of pouring channel 12. Radius $R_4$ of curved bearing surface describes the design along the longitudinal sectional view of this figure.

Each bearing surface 24 provides an additional curvature extending in a direction from said surface 18 to said section 20 as may be seen best from FIG. 2. Said additional curvature has the shape of a quadrant and is arranged at a distance from said surface 18, as may been seen from FIG. 2.

The peripheral area 22 of plate-like part 14 and the adjacent upper section of tubular part 10 are enclosed by a metallic envelope 28, which is shrunk or cemented onto the corresponding surface sections.

The shown nozzle with tubular part 10 and plate-like part 14 was pressed isostatically to provide a monolithic ceramic refractory body (monotube design) before the metallic envelope 28 was fitted as described.

It may be used as an outer nozzle (in the orientation according to FIGS. 1, 2) or as an inner nozzle by inverting through 180° or upside down.

As may be seen from FIGS. 1 and 3 three pushing devices 301, 30*m* and 30*r* are arranged along each of said bearing surfaces 24 in a row.

Pushing device 30*m* is arranged in such a way so that its pushing force, characterized by arrow $P_m$ is exactly directed towards the central longitudinal axis L of the pouring channel 12.

Pushing devices 301 and 30*r* on opposite sides with respect to pushing device 30*m* are arranged such that their corresponding pushing forces $P_1$, $P_r$ as transmitted by the bearing surfaces 24 through the plate-like part 14 do not run parallel to pushing force $P_m$ but slightly inclined towards the central longitudinal axis L without running through it.

This arrangement secures an increased and optimized fixation as well as optimized centering of the nozzle within a corresponding (not shown) clamping device while at the same time decreasing the risk of crack formation within the ceramic refractory material of plate-like part 14.

As may be seen from FIGS. 1 and 2 the said pushing devices 301, 30*m* and 30*r* are further arranged in such a way that the resulting thrust forces are applied with a vertical component in the direction of surface 18.

Figure 4:
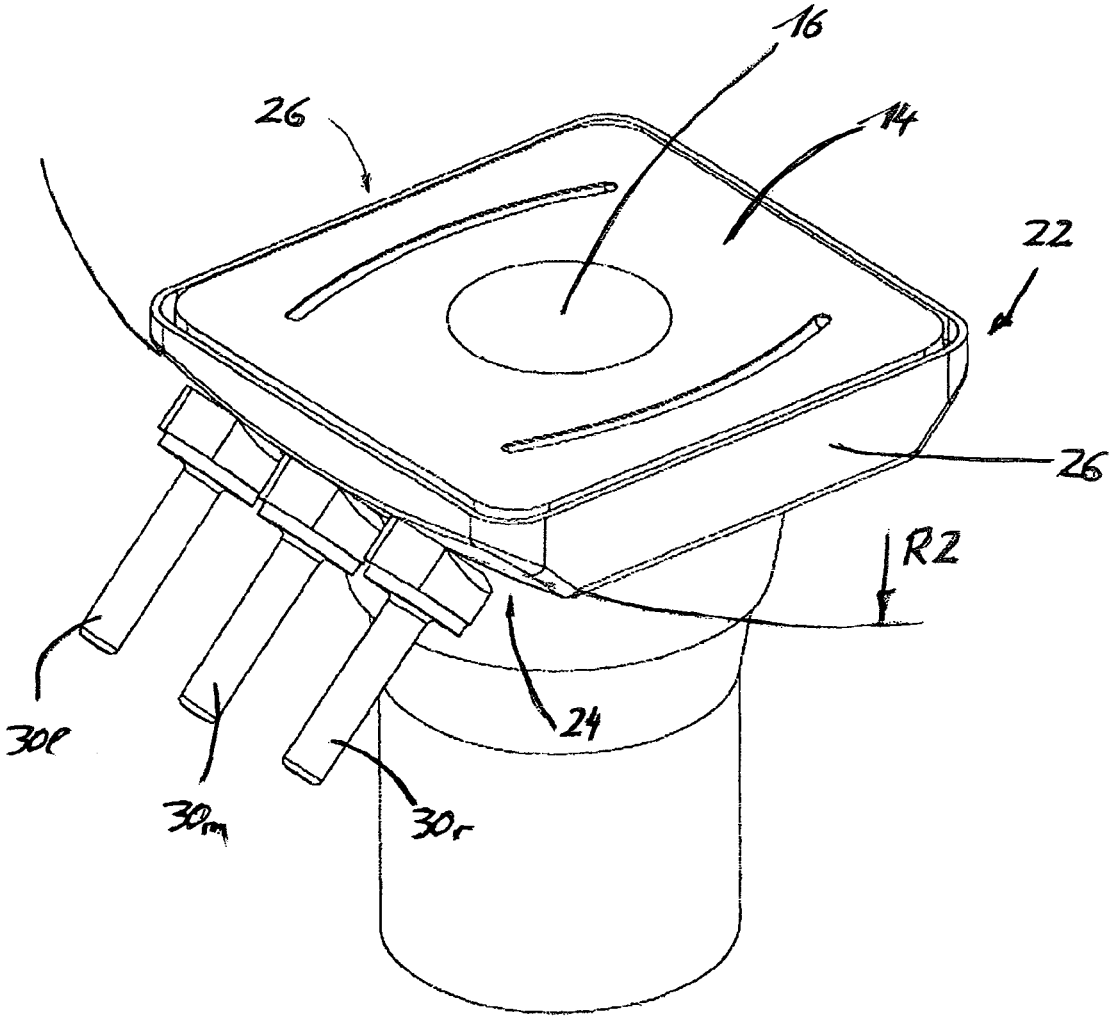
FIG. 4: a 3-dimensional view of a second embodiment.
Figure 6:
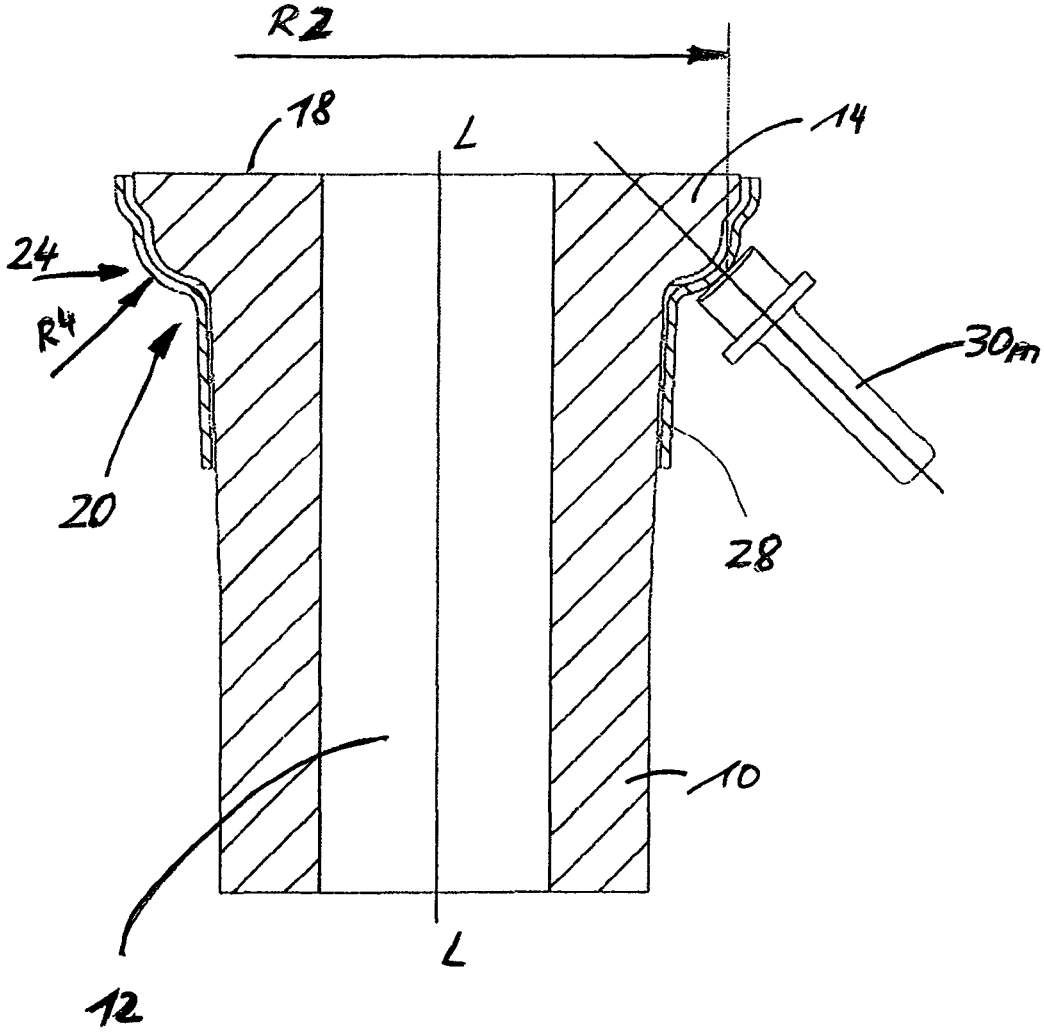

In FIGS. 4 and 6 two alternative embodiments are shown.

Figure 5:
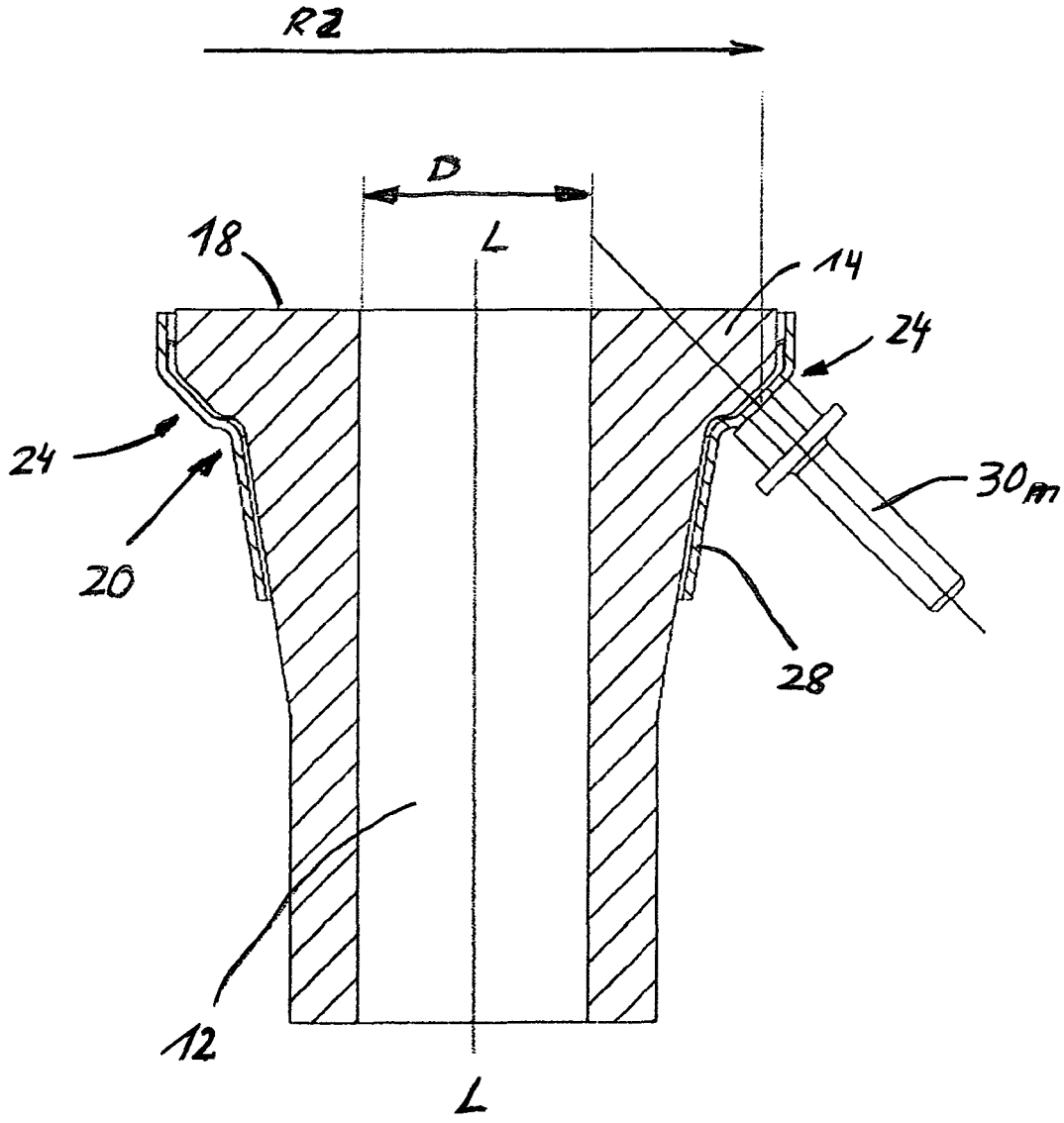
FIG. 5: a longitudinal sectional view of the nozzle in accordance with FIG. 4, FIG. 6: a longitudinal sectional view of a third embodiment.

In FIG. 4 the bearing surfaces 24 of the nozzle are part of a frustocone. The longitudinal cross section of the nozzle is shown in FIG. 5. The mean radius of this frustocone is $R_2$. The longitudinal cross section according to FIG. 6 shows a similar curvature of the bearing surfaces 24 of the embodiment in FIG. 2 but the radius $R_2$ is in an imaginary plane perpendicular to the longitudinal axis L of pouring channel 12.

The invention claimed is:

1. Pouring nozzle comprising the following features:

a) an elongated, tubular part (10), defining a first part (12*u*) of a pouring channel (12) with a central longitudinal axis (L), b) a plate like part (14), provided with a flow-through opening (16) between its surface (18) opposite the tubular part (10) and its section (20) adjacent said tubular part (10), c) the flow-through opening (16) defining a second part (12*o*) of the pouring channel (12), d) a peripheral area (22) of said plate like part (14), wherein the peripheral area (22) between said surface (18) and said section (20) comprises two distinct bearing surfaces (24) and two planar surface sections (26) arranged parallel to each other and between said two distinct bearing surfaces (24), e) each bearing surface (24) being curved with respect to the central longitudinal axis (L) of the pouring channel (12), f) said bearing surfaces (24) are arranged minor inverted with respect to the central longitudinal axis (L) of the pouring channel (12).

2. Pouring nozzle according to claim 1, wherein each bearing surface (24) provides a curvature extending along an imaginary plane comprising the central longitudinal axis (L).

3. Pouring nozzle according to claim 1, wherein each of said two bearing surfaces (24) provides a curvature of constant radius.

4. Pouring nozzle according to claim 1, wherein each of said two bearing surfaces (24) provides a curvature, corresponding to a parabola in a cross section perpendicular to the direction of the central longitudinal axis (L) of said pouring channel (12).

5. Pouring nozzle according to claim 1, wherein each of said two bearing surfaces (24) provides a curvature along an imaginary plane perpendicular to the direction of the central longitudinal axis (L) of the pouring channel (12) with a radius $R_2$ being at least 2 times larger than the diameter D of the flow through opening (16).

6. Pouring nozzle according to claim 1, wherein each of said two bearing surfaces (24) provides said curvature, extending along an imaginary plane comprising the central longitudinal axis (L) of the pouring channel (12) which curvature extends in a direction from said surface (18) opposite to the tubular part (10) to said section (20) adjacent said tubular part (10) such that the bearing surfaces are part of a funnel shape.

7. Pouring nozzle according to claim 6, wherein said curvature is of constant radius between its end opposite the tubular part (10) and said section (20) adjacent said tubular part (10).

8. Pouring nozzle according to claim 6, wherein said curvature extends partially between its end opposite the tubular part (10) and said section (20) adjacent said tubular part (10).

9. Pouring nozzle according to claim 1 or 2, wherein each of said bearing surfaces (24) provides a shape which corresponds to a partial surface of one of the following geometrical shapes: paraboloid, cone, dome, cylinder, torus.

10. Pouring nozzle according to claim 2, wherein each of said bearing surfaces (24) provides a shape, which corresponds, in a longitudinal section of the pouring nozzle, to at least one of the following geometrical shapes: parabola, involute.

11. Pouring nozzle according to claim 1, wherein the said plate like part (14) has a smaller cross sectional area at said section (20) adjacent said tubular part (10) than at its end opposite the tubular part (10).

12. Pouring nozzle according to claim 1 made of ceramic refractory material and designed as a one piece monolithic.

13. Pouring nozzle according to claim 1, wherein the said plate-like part (14) and the said tubular part (10) are isostatically pressed parts.

14. Pouring nozzle according to claim 1, surrounded at least partially, by a metallic envelope (28).

* * * * *